US009683479B2

(12) United States Patent
Cha

(10) Patent No.: US 9,683,479 B2
(45) Date of Patent: Jun. 20, 2017

(54) SAFETY CAP DEVICE FOR CONTROLLING PRESSURE IN RADIATOR AND METHOD FOR CONTROLLING PRESSURE USING THE SAME

(71) Applicant: HYUNDAI MOTOR COMPANY, Seoul (KR)

(72) Inventor: Yong Woong Cha, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 143 days.

(21) Appl. No.: 14/675,212

(22) Filed: Mar. 31, 2015

(65) Prior Publication Data

US 2016/0146094 A1 May 26, 2016

(30) Foreign Application Priority Data

Nov. 26, 2014 (KR) ..... 10-2014-0166598

(51) Int. Cl.
*F01P 7/14* (2006.01)
*B65D 51/16* (2006.01)
*F01P 11/02* (2006.01)

(52) U.S. Cl.
CPC ..... *F01P 11/0247* (2013.01); *F01P 7/14* (2013.01); *F01P 11/0238* (2013.01); *F01P 2007/146* (2013.01)

(58) Field of Classification Search
CPC ..... F01P 11/0247; F01P 11/0238; F01P 7/14; F01P 2007/146; F01P 2011/0266; F01P 11/0209; F01P 2011/0242
USPC ..... 123/41.08; 220/203, 203.26, 303, 301
See application file for complete search history.

(56) References Cited

U.S. PATENT DOCUMENTS 4,185,751 A * 1/1980 Moore ..... F01P 11/0238 220/203.26
6,390,318 B1 * 5/2002 Tanaka ..... H02G 3/10 220/23.4
2004/0099668 A1 * 5/2004 Reutter ..... F01P 11/0247 220/303

FOREIGN PATENT DOCUMENTS

JP 2012-233452 A 11/2012
KR 20-0388642 Y1 6/2005
KR 10-2008-0103167 A 11/2008
KR 10-2009-0079132 A 7/2009
(Continued)

OTHER PUBLICATIONS

Korean Office Action issued in Application No. 10-2014-0166598 dated Oct. 20, 2015.

*Primary Examiner* — Carlos A Rivera
*Assistant Examiner* — Syed O Hasan
(74) *Attorney, Agent, or Firm* — McDermott Will & Emery LLP

(57) ABSTRACT

A safety cap device for controlling a pressure in a radiator includes a valve seat provided with a valve receiving space in which a first communicating hole is formed. A negative pressure valve is provided movably in the first communicating hole. A seal is disposed on a receiving surface of the valve seat and disposed movably with the negative pressure valve. The seal has a second communicating hole formed at a central portion thereof. A positive pressure valve is disposed on the seal and has a third communicating hole formed at a central portion thereof. A cap covers an upper portion of the valve seat. A spring is interposed between the positive pressure valve and the cap. A fluid receiving part is in the valve seat to prevent cavitation caused when an internal fluid expands.

4 Claims, 3 Drawing Sheets

(56) References Cited

FOREIGN PATENT DOCUMENTS

| | | | |
|---|---|---|---|
| KR | 10-2012-0010807 | A | 2/2012 |
| KR | 10-1341992 | B1 | 12/2013 |
| KR | 10-1385350 | B1 | 4/2014 |

* cited by examiner

SAFETY CAP DEVICE FOR CONTROLLING PRESSURE IN RADIATOR AND METHOD FOR CONTROLLING PRESSURE USING THE SAME

CROSS-REFERENCE(S) TO RELATED APPLICATIONS

The present application claims priority of Korean Patent Application Number 10-2014-0166598 filed on Nov. 26, 2014, the entire contents of which application are incorporated herein for all purposes by this reference.

TECHNICAL FIELD

The present disclosure relates to a safety cap device for controlling a pressure in a radiator and a method for controlling the pressure using the same, and more particularly, to a safety cap device for controlling a pressure in a radiator, which discharges air through generation of bubbles and prevents a loss of cooling water, and a method for controlling the pressure using the same.

BACKGROUND

In a cooling system of a vehicle, a safety cap of a radiator prevents a pressure from increasing above a reference pressure when fluid (cooling water, vapor, or air) in the cooling system expands according to a temperature increase to protect the cooling system when an engine starts. In addition, the safety cap prevents the pressure in the cooling system from decreasing below atmospheric pressure when the volume of fluid decreases according to cooling of the cooling system when the engine stops or supplements cooling water using such negative pressure.

In the above safety cap, as the means for realizing the above operation, a spring is mainly used to adjust a positive pressure (when discharged) and a negative pressure (when entered). A positive pressure valve is provided for preventing the volume of internal fluid from being increased when the cooling system is heated, and a negative pressure valve is provided for reducing the pressure (negative pressure) generated by volume reduction of internal fluid when the cooling system is cooled.

Here, in order to allow the positive pressure valve to perform its function when the positive pressure is applied, the cooling water must be secured when the volume of cooling water expands. Therefore, opening/closing of the negative pressure valve is adjusted by a spring for the negative pressure valve to prevent the negative pressure valve from being opened.

In the conventional safety cap, however, due to a spring force of the spring for the negative pressure valve, the negative pressure valve does not open smoothly, and thus, the negative pressure valve does not perform its function. In addition, when the negative pressure valve is not smoothly opened, the valve presses a seal (rubber) for long time so that the tackiness may be generated between the seal and the valve. Therefore, the cooling water is not supplied smoothly in the cooling system, thus distorting a hose. In particular, a venting function for air and vapor in the cooling system does not perform smoothly, thus deteriorating performance and reliability of the safety cap as well as reliability of the vehicle.

The above structure described as the background art is provided for only understanding the background of the present disclosure, however it should not be accepted that the present disclosure corresponds to the conventional art which has been already well-known to one having an ordinary skill in the art.

SUMMARY OF THE INVENTION

An aspect of the present inventive concept provides a safety cap device for controlling a pressure in a radiator for a vehicle, which can discharge air through generation of bubbles and prevent a loss of cooling water to secure operational reliability of a cooling system, and a method for controlling the pressure using the same.

A safety cap device for controlling a pressure in a radiator of a cooling system for a vehicle according to an embodiment of the present inventive concept includes a valve seat provided with a valve receiving space in which a first communicating hole is formed. A negative pressure valve is provided movably in a vertical direction inside the first communicating hole. A seal is disposed on a receiving surface of the valve seat in the valve receiving space and disposed movably with the negative pressure valve. The seal has a second communicating hole formed at a central portion thereof. A positive pressure valve is disposed on the seal and has a third communicating hole formed at a central portion thereof. A cap covers an upper portion of the valve seat. A spring is interposed between the positive pressure valve and the cap. A fluid receiving part is provided in the valve seat to prevent cavitation from being generated when an internal fluid expands.

The negative pressure valve may have a shaft shape and have an engaging part at an upper portion thereof inside the third communicating hole to restrict downward movement of the negative pressure valve. The seal may be formed of rubber material and have a ring shape. The positive pressure valve may have a protrusion formed on an edge thereof. The cap has a ring-shaped assembling protrusion protruding downward from an upper surface thereof inside the cap, and the valve seat is assembled to the ring-shaped assembling protrusion.

The fluid receiving part has a receiving space for receiving the internal fluid and moving together with the negative pressure valve.

The fluid receiving part may have an inverted U-shape or an inverted V-shape.

The fluid receiving part may further include a foam part collecting air bubbles.

The fluid receiving may be mounted integrally to a lower end of the negative pressure valve.

A safety cap device for controlling a pressure in a radiator of a cooling system for a vehicle according to another embodiment of the present inventive concept is characterized in which a negative pressure valve connected to a fluid receiving part, which collects a gas generated by cooling water of the cooling system, moves upward. The negative pressure valve is closed by a spring and a positive pressure valve is simultaneously open when the pressure in the cooling system is higher than the atmosphere pressure. The positive pressure valve is closed by the spring and the negative pressure valve is simultaneously open when the pressure in the cooling system is lower than the atmosphere pressure.

A method for controlling the pressure in the radiator of the cooling system for a vehicle according to the embodiment of the present inventive concept includes raising the negative pressure valve connected to the fluid receiving part which collects a gas generated by cooling water of the cooling system. The negative pressure valve is closed by the spring, and simultaneously, the positive pressure valve is open when the pressure in the cooling system is higher than the atmosphere pressure. The positive pressure valve is closed by the spring, and simultaneously, the negative pressure valve is open when the pressure in the cooling system is lower than the atmosphere pressure.

The negative pressure valve may move upward by the fluid receiving part which has an empty space and is mounted integrally to a lower end of the negative pressure valve.

According to the safety cap device and the method for controlling a pressure in the radiator of the present invention as described above, since the negative pressure valve can be rapidly actuated when a negative pressure is generated in the cooling system, an air vent function is enhanced, a tackiness between the valve and the seal is prevented and a distortion of hose is prevented by smoothly supplementing cooling water. Therefore, a performance of the safety cap is secured to enhance a reliability of the safety cap device as well as the vehicle.

In the cooling system, in other words, the present invention removes a resistance, which is generated by a reduction of volume when a temperature of cooling water is lowered and inhibits an opening of the negative pressure valve, to enable the negative pressure valve to be immediately opened when a supplement of cooling water is required.

In the present invention, air accumulated around the safety cap device can be easily discharged at the beginning of starting the engine to smoothly remove bubbles in cooling water, and the valve is immediately closed after discharging bubbles to minimize or prevent a discharge of cooling water and to pressurize the cooling system as in the conventional cooling system.

In addition, the present disclosure elastically supports the valve and has a simple structure, thus improving a manufacturing process, enhancing the productivity, and reducing errors, assembling process manufacturing cost by reducing the number of parts.

DESCRIPTION OF SPECIFIC EMBODIMENTS

Figure 1:
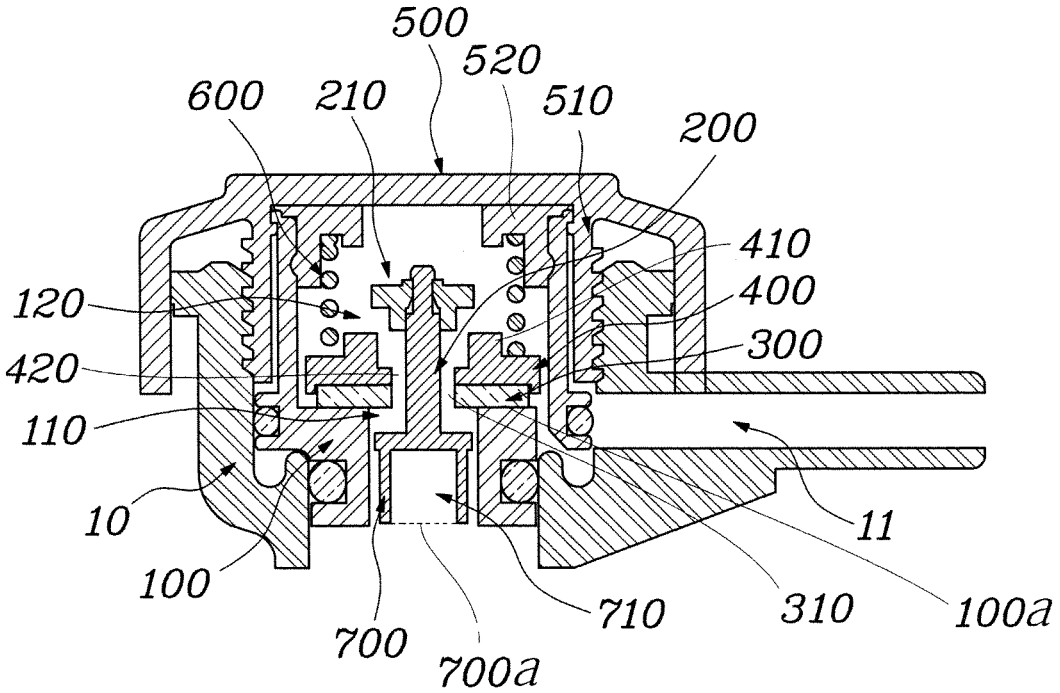
FIG. 1 is a cross-sectional view of a safety cap device for controlling a pressure in a radiator according to an embodiment of the present inventive concept.

Exemplary embodiments of the present inventive concept will be described below in more detail with reference to the accompanying drawings. The present inventive concept may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present inventive concept.

Figure 2:
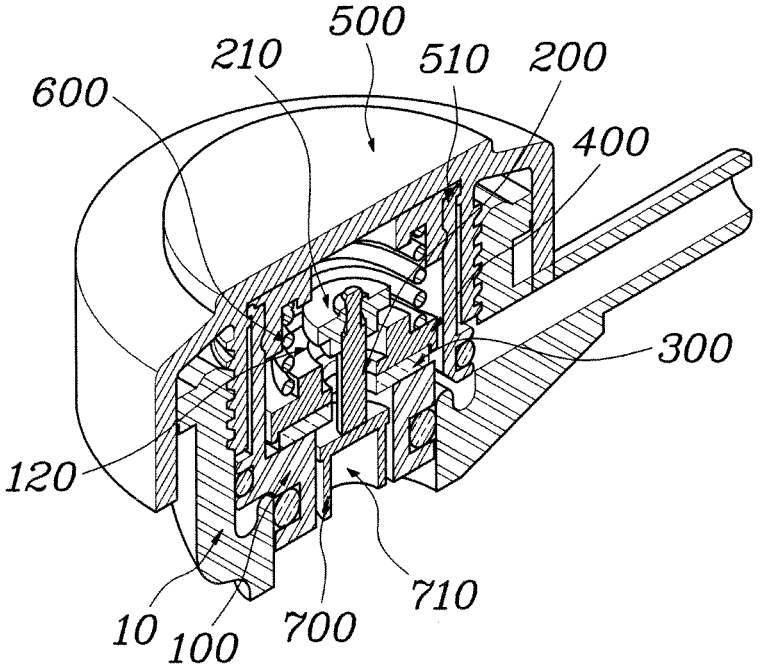
FIG. 2 is a partial cut-out perspective view of a safety cap device for controlling a pressure in a radiator according to the embodiment of the present inventive concept.
Figure 3:
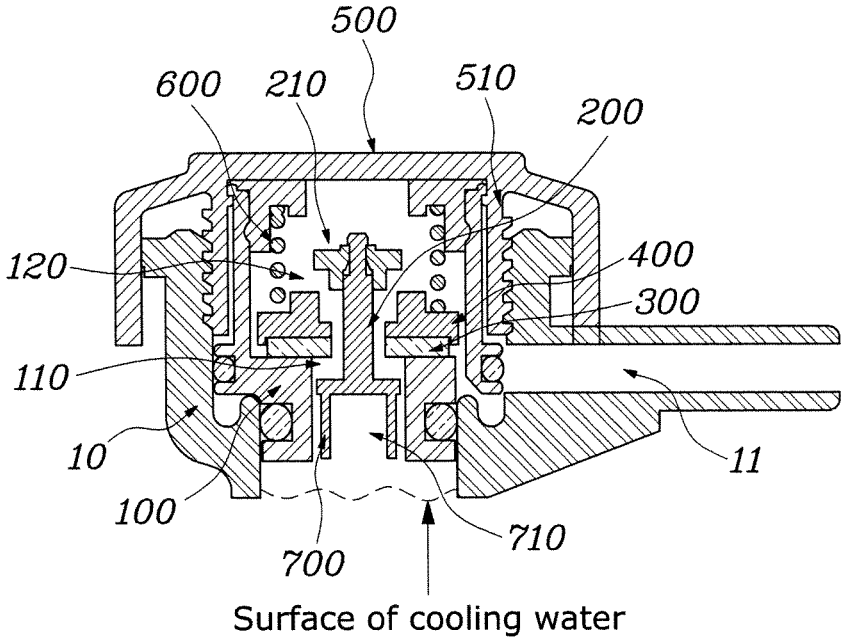
FIGS. 3-6 are views showing an operation process of a safety cap device for controlling a pressure in a radiator according to the embodiment of the present inventive concept.

FIG. 1 is a cross-sectional view of a safety cap device for controlling a pressure in a radiator according to an embodiment of the present inventive concept, and FIG. 2 is a partial cut-out perspective view of a safety cap device for controlling a pressure in a radiator according to the embodiment of the present inventive concept.

The present disclosure relates to a safety cap device capable of for controlling a pressure for a radiator of a vehicle cooling system. The safety cap device according to the present disclosure can remove resistance, which is generated by volume reduction when a temperature of cooling water decreases and prevents a negative pressure valve from being opened, to enable the negative pressure valve to be immediately opened when cooling water needs to be supplemented. Therefore, an air vent function is enhanced, adhesion between a valve and a seal is prevented, and distortion of a hose is prevented by smoothly supplementing the cooling water. As a result, operational reliability of the safety cap device as well as the vehicle is improved.

Referring to FIGS. 1 and 2, a safety cap device for controlling a pressure in a radiator according to the present disclosure is coupled to a cooling water inlet port 10 having a cooling water overflow hole or a cooling water overflow passage 11 at one side thereof. The safety cap device includes a valve seat 100 provided with a valve receiving part 120 which has a first communicating hole 110 formed at a central portion thereof. The first communicating hole 110 communicates with the cooling water inlet port 10. A negative pressure valve 200 is movable vertically in the first communicating hole 110 of the valve seat 100. A seal 300 is disposed on a receiving surface 100*a* of the valve seat 100, movable in response to movement of the negative pressure valve 200, and has a second communicating hole 310 formed at a central portion thereof. A positive pressure valve 400 is disposed on the seal 300 and has a third communicating hole 420 formed at a central portion thereof. A cap 500 covers and protects an upper portion of the valve seat 100. A spring 600 is interposed between the positive pressure valve 400 and the cap 500 and generates a spring force on the positive pressure valve 400 and the cap 500. A cavitation preventing means is provided in the valve seat 100 to prevent cavitation caused by an expansion of internal fluid from being generated.

The valve seat 100 allows an upper end portion thereof to be assembled to an annular assembling protrusion 510 formed on the cap 500, which will be described later.

The negative pressure valve 200 generally has a shaft shape. An engaging part 210 is provided at an upper portion of the negative pressure valve 200 and is engaged with the communicating hole of the positive pressure valve 400, which will be described later, to restrict downward movement thereof.

The seal 300 is formed of rubber material and is disposed between the negative pressure valve 200 and the positive pressure valve 400. The seal 300 has a ring shape having the communicating hole formed at the central portion thereof and is disposed on the receiving surface 100*a* of the valve seat 100.

The positive pressure valve 400 has the communicating hole formed at the central portion thereof, and a protrusion 410 is formed on an edge thereof to prevent the spring 600 from being strayed out of place. Therefore, the spring 600 is placed on an outside of the protrusion 410.

The annular assembling protrusion 510 having a ring shape is formed at an inside of the cap 500 and has a spiral shape on an outer circumferential surface of the ring-shaped assembling protrusion 510. The cap 500 is screw-coupled to the cooling water inlet port 10 through the ring-shaped assembling protrusion 510. In addition, a spring seating part 520 is formed at an inside of the cap 500, which has a receiving groove for receiving an end portion of the spring 600. Due to the above structure, the spring 500 is stably disposed between the spring seating part 520 and the positive pressure valve 400.

The cavitation preventing means includes a fluid receiving part 700 having a receiving space 710 (empty space) for receiving an internal fluid of a cooling system when the internal fluid starts expanding (for example, cooling water, vapor, air) in the cooling system, and the fluid receiving part 700 moves together with the negative pressure valve 200.

If gas and the like can be collected in the fluid receiving part 700, a shape of the fluid receiving part is not limited. For example, the fluid receiving part may have an inverted U-shape or inverted V-shape and is formed integrally with a lower end portion of the negative pressure valve 200. A foam 700*a* such as Styrofoam and the like capable of collecting air bubbles may be further provided in the inverted U-shape or the inverted V-shape of the fluid receiving part 700.

The drawings illustrate that the fluid receiving part 700 has the inverted U-shape and is formed integrally with the negative pressure valve 200.

Next, an operation of the safety cap device for controlling a pressure in a radiator according to the present disclosure is described with reference to FIGS. 3-6. FIGS. 3-6 are views showing an operation process of the safety cap device for controlling a pressure in a radiator according to an embodiment of the present inventive concept. In the figures, the dotted lines indicate a surface of the cooling water.

Figure 4:
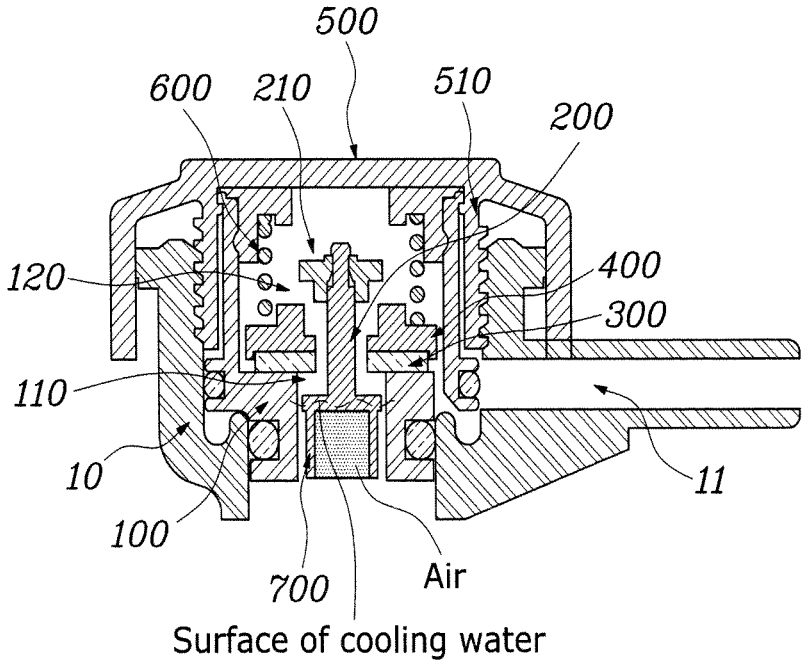
Figure 5:
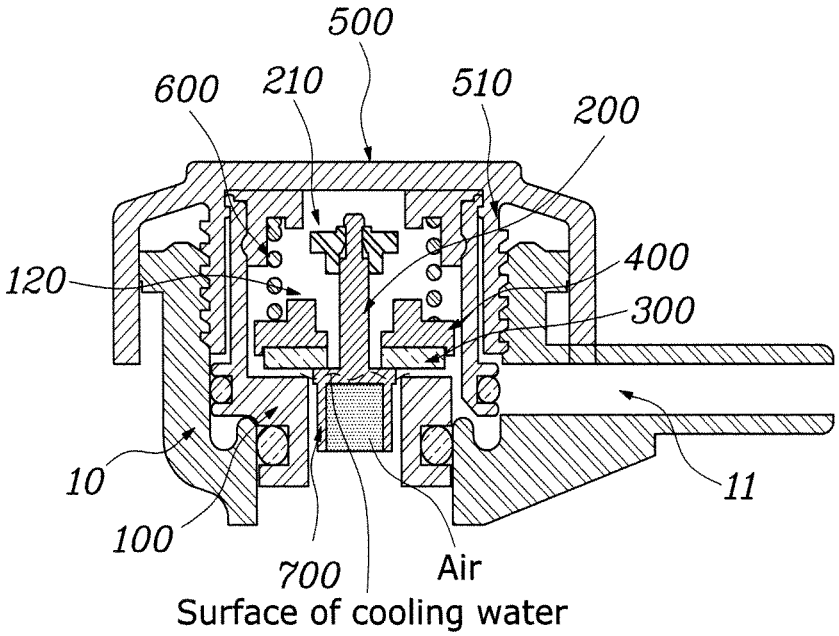
Figure 6:
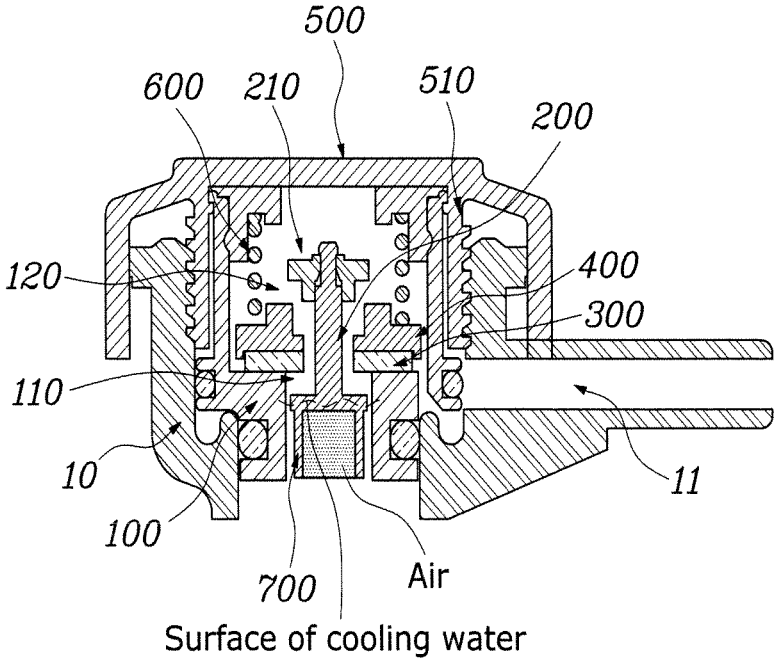

When a vehicle initially starts (cold start), once the negative pressure valve 200 is open (see FIG. 3) and the surface of cooling water rises, air (bubbles) is formed when the cap device is filled with the cooling water, and the air is collected in the fluid receiving part 700 which is a cavitation preventing means so that the negative pressure valve 200 linked to the fluid receiving part 700 moves upward (see FIG. 4).

Sequentially, once a temperature of cooling water increases (in a case in which the pressure in the cooling system is higher than atmospheric pressure), the negative pressure valve 200 overcomes a spring force of the spring 600 and moves upward. As a result, the negative pressure valve 200 is closed. Simultaneously, due to the increased pressure in the cooling system, the positive pressure valve 400 also moves upward and is open and the cooling water is thus discharged to a reservoir (not shown) through the overflow passage 11 (see FIG. 5).

In addition, when an engine stops (KEY OFF; in a case in which the pressure in the cooling system is lower than the atmospheric pressure), the positive pressure valve 400 is closed by the spring force of the spring 600. At this time, the negative pressure valve 200 is open when the pressure and a cooling water level are lowered (see FIG. 6).

In the safety cap device for controlling the pressure in the radiator according to the present disclosure when the engine starts, the receiving space 710 (empty space) of the fluid receiving part 700 is formed at a lower end of the negative pressure valve 200 to allow the air (bubbles) to be stored therein when the cooling water level rises. Then, the empty space of the receiving space 710 is filled with bubbles, and other empty spaces are filled with the cooling water as the cooling water level rises such that the negative pressure valve 200 moves upward as much as cooling water level. Once all surrounding bubbles are discharged and the cooling water level rises to a height of the seal 300, the positive pressure valve 400 is automatically closed. Then, the negative pressure valve 200 is maintained in a closed state by a pressure difference between an outside and an inside thereof (between the pressure in the cooling system and the atmospheric pressure) and is operated using a conventional method.

Next, an operation of the safety cap device after the engine stops (OFF) will be described. As the cooling water in the cooling system is cooled, the volume of cooling water is reduced and the pressure is lowered. Therefore, the spring force of the spring 600, by which the negative pressure valve 200 is pushed, is also removed. If a temperature of cooling water further decreases and the internal pressure is thus reduced, the cooling water level in the cooling water inlet port 10 is lowered so that the positive pressure valve 400 moves downward along the cooling water and the negative pressure valve 200 is opened. Here, since the internal pressure is lower than the external pressure, the cooling water is supplemented from the outside.

According to the safety cap device and the method for controlling a pressure in the radiator of the present disclosure, since the negative pressure valve can be rapidly actuated when a negative pressure is generated in the cooling system, an air vent function is enhanced, adhesion between the valve and the seal is prevented and distortion of hose is prevented by smoothly supplementing cooling water. Therefore, performance of the safety cap is secured to enhance reliability of the safety cap device as well as the vehicle.

The cooling system according to the present invention removes resistance, which is generated by a volume reduction when a temperature of cooling water decreases and prevents the negative pressure valve from being open, can immediately open the negative pressure valve when the cooling water needs to be supplemented. Therefore, air accumulated around the safety cap device can be discharged when initially starting the engine to smoothly remove bubbles in the cooling water, and the positive pressure valve is immediately closed after discharging the bubbles to minimize or prevent the discharge of cooling water and to pressurize the cooling system as in the conventional cooling system.

In addition, the safety cap device according to the present disclosure can elastically support the valve by a simplified structure to improve a manufacturing process and eliminate device errors, and thus, enhancing productivity, reducing an assembling process and reducing manufacturing cost by reducing the number of parts.

While the present disclosure has been described with respect to the specific embodiments, it will be apparent to those skilled in the art that various changes and modifications may be made without departing from the spirit and scope of the invention as defined in the following claims.

What is claimed is:

1. A safety cap device for controlling a pressure in a radiator of a cooling system for a vehicle, the device comprising:

a valve seat having a valve receiving space therein and a first communicating hole formed in the valve receiving space;

a negative pressure valve provided movably in a vertical direction inside the first communicating hole;

a seal disposed on a receiving surface of the valve seat in the valve receiving space and disposed movably with the negative pressure valve, the seal having a second communicating hole which is formed at a central portion of the seal and communicates with the first communicating hole;

a positive pressure valve disposed on the seal and having a third communicating hole which is formed at a central portion of the positive pressure valve and communicates with the second communication hole;

a cap covering an upper portion of the valve seat;

a spring interposed between the positive pressure valve and the cap; and a fluid receiving part provided in the valve seat to prevent cavitation from being generated when an internal fluid expands, wherein the fluid receiving part includes a receiving space for receiving the internal fluid and moving together with the negative pressure valve, and wherein the fluid receiving part includes a foam part collecting air bubbles, and the foam part is disposed in the receiving space of the fluid receiving part.

2. The safety cap device of claim 1, wherein the negative pressure valve has a shaft shape and has an engaging part at an upper portion thereof inside the third communicating hole to restrict downward movement of the negative pressure valve, the seal is formed of a rubber material and has a ring shape, the positive pressure valve has a protrusion formed on an edge thereof, and the cap has a ring-shaped assembling protrusion protruding downward from an upper surface thereof inside the cap, and the valve seat is assembled to the ring-shaped assembling protrusion.

3. The safety cap device of claim 1, wherein the fluid receiving part has an inverted U-shape or an inverted V-shape.

4. The safety cap device of claim 3, wherein the fluid receiving part is mounted integrally to a lower end of the negative pressure valve.

* * * * *